US005489037A

United States Patent [19]

Stopper

[11] Patent Number: 5,489,037

[45] Date of Patent: Feb. 6, 1996

[54] CONTAINER LINER SYSTEM FOR BULK TRANSFER

[75] Inventor: Raymond J. Stopper, Houston, Tex.

[73] Assignee: Insta-Bulk, Inc., Houston, Tex.

[21] Appl. No.: 293,562

[22] Filed: Aug. 18, 1994

Related U.S. Application Data

[63] Continuation of Ser. No. 174,764, Dec. 29, 1993, abandoned, which is a continuation of Ser. No. 738,259, Jul. 30, 1991, abandoned.

[51] Int. Cl.[6] ..... H05B 3/68

[52] U.S. Cl. ..... 220/1.5; 220/403; 220/404; 220/470

[58] Field of Search ..... 220/1.5, 470, 403, 220/404

[56] References Cited

U.S. PATENT DOCUMENTS

| | | | |
|---|---|---|---|
| 1,401,419 | 12/1921 | McNally . | |
| 1,499,229 | 6/1924 | Laffey . | |
| 1,815,653 | 7/1931 | Jones . | |
| 1,944,280 | 1/1934 | Snyder | 428/178 X |
| 2,144,181 | 1/1939 | Du Bois . | |

(List continued on next page.)

FOREIGN PATENT DOCUMENTS

| | | |
|---|---|---|
| 650159 | 4/1967 | Belgium . |
| 948039 | 5/1974 | Canada . |
| 1205106 | 5/1986 | Canada . |
| 0276994 | 3/1988 | European Pat. Off. . |
| 1385534 | 12/1964 | France . |
| 2512790 | 3/1983 | France . |
| 533317 | 8/1931 | Germany . |
| 2027842 | 1/1971 | Germany . |
| 2161631 | 6/1973 | Germany . |
| 295021 | 6/1965 | Netherlands . |
| 1089874 | 11/1967 | United Kingdom . |
| 1241162 | 7/1971 | United Kingdom . |
| 2072618 | 10/1981 | United Kingdom . |
| 2110192 | 6/1983 | United Kingdom . |

OTHER PUBLICATIONS

European Search Report.

Johann Birkhart letter of Sep. 3, 1984, second page, sixth paragraph, Antwerp, Belgium.

Photographs in the United States as early as Mar. 1985 depicting use of a liner system known in the art as the "Bag–in–the–Box" type liner.

Insta–Bulk, Inc. sketches, Raymond J. Stopper, Jun. 21, 1981, pertaining to a liner system believed to have been offerred for sale and/or sold by Insta–Bulk, Inc. in 1981 or 1982.

Photographs of the interior of a container used in the United States by Union Carbide as early as May 1983.

Railway Age, Jul. 28, 1969, "*Action in the end zone: A bigger Hopper*".

Sea Bulk Powerliner—Powertex, Inc. brochure.

Unispeed Intermodal Ltd., Southampton, England, brochure entitled "Unispeed for Worldwide Flexible Bulk Liquid Transportation".

Aero Tec Laboratories Inc., Ramsey, N.J., brochure entitled "Combining high tensile fibers with synthetic elastomers for new dimensions in fluid handling technology".

Aero Tec Laboratories Inc., Ramsey, N.J., brochure entitled "Tube Tanks Collapsible Bulk–Liquid Transport Bladders" (1983).

Josef Nittel KG, Linerbag for ISO/ASA Container intallation instruction brochure.

(List continued on next page.)

*Primary Examiner*—Steven M. Pollard
*Attorney, Agent, or Firm*—Fish & Richardson

[57] ABSTRACT

This invention relates to systems of handling flowable cargo in lined cargo containers. An inflatable, self-installing liner configured to line the container, when inflated, is installed and inflated within the container. A transparent, rigid bulkhead keeps the filled liner from transferring load directly to access doors to the container. Special inflatable bags are provided between the liner and the container at positions where cargo tends to remain during unloading of the liner.

16 Claims, 10 Drawing Sheets

U.S. PATENT DOCUMENTS

| | | | |
|---|---|---|---|
| 2,712,797 | 7/1955 | Woehrle et al. . | |
| 2,748,673 | 6/1956 | Winstead . | |
| 2,896,839 | 7/1959 | Barnes et al. . | |
| 2,931,523 | 4/1960 | Nelligan . | |
| 2,956,839 | 10/1960 | Hermanns . | |
| 2,989,213 | 6/1961 | Daggitt . | |
| 3,044,653 | 7/1962 | Tantlinger . | |
| 3,061,133 | 10/1962 | Reynolds . | |
| 3,085,707 | 4/1963 | Tantlinger . | |
| 3,087,491 | 4/1963 | Gewecke et al. . | |
| 3,087,759 | 4/1963 | Worster . | |
| 3,105,617 | 10/1963 | Felldin . | |
| 3,163,544 | 12/1964 | Valyi . | |
| 3,170,600 | 2/1965 | Pierson . | |
| 3,171,449 | 3/1965 | Ellms et al. . | |
| 3,173,573 | 3/1965 | Donegan . | |
| 3,199,726 | 8/1965 | Pierson . | |
| 3,201,000 | 8/1965 | Hermanns . | |
| 3,235,432 | 2/1966 | George | 229/DIG. 2 X |
| 3,273,761 | 9/1966 | Langen . | |
| 3,275,197 | 9/1966 | Eklund . | |
| 3,309,007 | 3/1967 | Rosenberg et al. . | |
| 3,351,235 | 11/1967 | Paton . | |
| 3,384,106 | 5/1968 | Isbrandtsen . | |
| 3,386,605 | 6/1968 | Lafont . | |
| 3,393,835 | 7/1968 | Kantor et al. . | |
| 3,421,665 | 1/1969 | Paton . | |
| 3,544,417 | 12/1970 | Corzine | 428/178 X |
| 3,574,332 | 4/1971 | Wetzel . | |
| 3,578,213 | 5/1971 | Clarke . | |
| 3,583,330 | 6/1971 | Freudman et al. . | |
| 3,595,175 | 7/1971 | Austill . | |
| 3,604,578 | 9/1971 | Smith . | |
| 3,696,952 | 10/1972 | Bodenheimer . | |
| 3,726,067 | 4/1973 | Fesco . | |
| 3,756,469 | 9/1973 | Clark et al. . | |
| 3,762,341 | 10/1973 | Adler | 410/129 X |
| 3,815,653 | 6/1974 | Scott et al. . | |
| 3,822,919 | 7/1974 | Strom . | |
| 3,868,042 | 2/1975 | Bodenheimer . | |
| 3,941,258 | 3/1976 | Ide . | |
| 3,951,284 | 4/1976 | Fell et al. . | |
| 3,978,996 | 9/1976 | Oltrogge . | |
| 3,980,196 | 9/1976 | Paulyson et al. . | |
| 4,054,226 | 10/1977 | Bjelland et al. . | |
| 4,098,425 | 7/1978 | Yamamoto . | |
| 4,124,136 | 11/1978 | Bjelland et al. . | |
| 4,150,186 | 4/1979 | Kazama | 428/178 X |
| 4,170,946 | 10/1979 | Youness . | |
| 4,186,845 | 2/1980 | Podd . | |
| 4,232,803 | 11/1980 | Muller et al. . | |
| 4,251,013 | 2/1981 | Krause . | |
| 4,334,812 | 6/1982 | Delatush . | |
| 4,345,862 | 8/1982 | Blout et al. . | |
| 4,358,233 | 11/1982 | Morris et al. . | |
| 4,385,953 | 5/1983 | Beck . | |
| 4,399,737 | 8/1983 | Severson . | |
| 4,421,250 | 12/1983 | Bonerb et al. . | |
| 4,441,627 | 4/1984 | Takeuchi . | |
| 4,461,402 | 7/1984 | Fell et al. . | |
| 4,470,749 | 9/1984 | Koudstaal . | |
| 4,498,824 | 2/1985 | Kinkle . | |
| 4,556,349 | 12/1985 | Koudstaal et al. . | |
| 4,595,126 | 6/1986 | Holmes . | |
| 4,629,390 | 12/1986 | Burke . | |
| 4,673,112 | 6/1987 | Bonerb . | |
| 4,701,087 | 10/1987 | Cain et al. . | |
| 4,784,287 | 11/1988 | Yamada et al. . | |
| 4,799,607 | 1/1989 | Podd . | |
| 4,854,801 | 8/1989 | Bonerb . | |
| 4,884,722 | 12/1989 | Podd . | |
| 4,911,317 | 3/1990 | Schloesser | 220/1.5 |
| 4,913,321 | 4/1990 | Abboud . | |
| 5,010,943 | 4/1991 | Boyer . | |
| 5,040,693 | 8/1991 | Podd, Sr. et al. . | |
| 5,059,084 | 10/1991 | Krein | 220/404 X |
| 5,152,735 | 10/1992 | Podd, Sr. et al. . | |
| 5,167,472 | 12/1992 | Podd, Sr. et al. . | |
| 5,181,625 | 1/1993 | Podd, Sr. et al. . | |
| 5,193,710 | 3/1993 | Podd, Sr. et al. . | |
| 5,217,184 | 6/1993 | Terrani | 410/129 X |

OTHER PUBLICATIONS

Stone Container Corporation, Marino ConTents brochure.

"Bold Strategies For A Brave New Market", *Business Month*, p. 28, Aug. 1989.

Hapag–Lloyd brochure re disposable liner bag system (p. 3 only).

Van Leer brochure entitled "A revolution in the discharge of ISO bulk containers" (1983).

Powertex Inc., Rouses Point, N.Y., "No–tilt Bulkcontainer Discharge System Instruction Manual".

Network Cargo Systems, Rotterdam, brochure entitled "Tilt Bulk Container discharge System".

Fruehauf Corporation brochure entitled "Fruehauf All–Flow Bulk Transportation System".

Sea–Land, Powertex Corp., Insta–Bulk, Inc. brochure entitled "Sea Bulk Powerliner".

CONTAINER LINER SYSTEM FOR BULK TRANSFER

This is a file wrapper continuation of U.S. Ser. No. 08/174,764 filed Dec. 29, 1993 (now abandoned) which is a file wrapper continuation of U.S. Ser. No. 738,259 filed Jul. 30, 1991 (now abandoned).

BACKGROUND OF THE INVENTION

A. Field of the Invention

The present invention relates broadly to systems for loading and unloading cargo containers with fluid-like or fluidizable cargos. The invention more particularly concerns a system wherein a self-installing, self-fitting liner is inflated within a cargo container, and a cargo is then charged into the liner. Special features include a transparent bulkhead to permit observation of the cargo and inflatable bags to improve recovery of cargo from the container.

B. Description of the Related Art

Conventional cargo containers are routinely used to transport flowable bulk cargo such as pelletized plastic, grain, pulverized materials and the like. These containers may be transported on truck beds or rail cars or individually shipped in container ships or on barges. They may also be used to store materials at sites to which they are delivered. Typically, these containers conform to standard specifications regulated by the American Standard Association or similar international associations.

Where flowable bulk cargo, including liquid and semi-liquid material, is to be transported in a conventional cargo container, modern practice typically dictates protecting both the cargo and container with a flexible liner. The dimensions of the liner roughly correspond to the internal dimensions of the container. Containment of the cargo inside such a liner provides many advantages including protection of the container from contaminating cargo, protection of the cargo from contamination, exclusion of dust and moisture from the cargo, and similar functions. Many different styles of liners have been designed to accommodate the various functions required.

The installation, loading and unloading of bulk cargo from liners within containers has been a fertile area for invention. Many liners, for example, require the use of a bulkhead positioned between the liner and the unloading portal. This portal, in most cases, embodies the rear doors of the container. In a typical transportation operation, the load within the liner is transferred to the bulkhead which may serve as a load-bearing retaining wall or may transfer the load to another load-bearing retaining wall such as the doors of the container. As noted above, such doors are normally at the rear end of a container, and they will be referred as the "rear doors" herein.

During a typical unloading process, bulk cargo is removed from a container by first allowing gravity flow, establishing a line of repose of the cargo within the container and then tilting the entire container and achieving further gravity flow of the bulk cargo out of the liner through a portal in the bulkhead positioned near the rear doors of the container. Alternatively, low pressure suction devices may be used to eliminate the requirement for tilting. Unloading with suction, however, requires special equipment. Although it is possible to remove a large percentage of the cargo from a container using the above conventional techniques, typically there is a residual amount of the cargo retained in the corners nearest the unloading portal.

Several bulk cargo handling systems already have been designed which attempt to overcome the above problems. For instance, numerous patents have been issued for bulkheads, liners, and unloading assistance devices. Some patents describe bulk cargo handling systems which include all three such features—i.e., bulkheads, liners, and unloading assistance devices.

BULKHEADS

Removable bulkheads used in cargo containers are well known. For the most part, however, such bulkheads are very heavy, wall-like structures requiring substantial support to withstand a load. Certain designs require the bulkhead to serve as the principal load-bearing member replacing, for example, the rear doors of a container.

In other cases, the bulkhead is not required to serve as a structural support member but may serve instead as a baffle inside a flowable bulk cargo container, or merely as a partition to retain refrigerated air. In yet other designs, the bulkhead may be separate and distinct from the container, relying instead on structural members extraneous to the container to provide the necessary support needed in, for instance, a tilting, gravity unloading process.

In yet other designs, the bulkhead may not serve as the load-bearing wall by virtue of its flexible, yieldable nature. Such a bulkhead, when stressed by a load, flexes toward the rear doors of the container thereby transferring the load directly to those rear doors. In designs such as this, safety during transportation and unloading of the cargo is dependent upon the integrity and safe opening of the rear doors.

Bulkheads may be made from a variety of materials including metal, wood, corrugated cardboard, reinforced plastic, and structurally molded plastic. Where a bulkhead material is used which must be reinforced, typically wooden or metallic supporting framework is added.

The bulkheads described above suffer from several limitations. First, although lightweight bulkheads are known, these bulkheads either must rely on substantial supporting framework or must flex to contact a load-bearing, rear door of a container. As noted, when a bulkhead yields and transfers the load within a liner to the rear doors of a container, safety concerns are raised. Heavier bulkheads improve this aspect of flexible bulkheads; however, such heavy-duty bulkheads are unwieldy, require special equipment or extra manpower for installation, and increase the cargo weight considerably.

Second, the bulkheads described above limit viewability of the inside of a container and its liner. The ability to observe interior cargo spaces while a bulkhead is in place is important to many aspects of the handling of bulk cargo. For instance, where liners are installed for receiving bulk cargo, such liners are first expanded or inflated. With most bulkheads, however, it is difficult if not impossible to ascertain whether the liner is fully expanded or properly aligned. It is also difficult to ascertain the level of cargo within such a liner. This is important information to ascertain, not only during loading, but also during actual transport. The possibilities of cargo shifting, contamination, moisture, field inspection, etc., are all reasons for being able to view a cargo within a liner and behind a bulkhead. Unfortunately, known bulkheads and liners are deficient in this regard.

LINERS

Flexible liners used in conjunction with bulk cargo containers are also known in the art. In some cases, the liners are used without a separate bulkhead in addition to the rear doors of the container. In other cases, the liners require elaborate, tedious, man-power intensive installations involving hooks and straps to support the liners in an open configuration. In still other designs, internal structural frameworks are required to suspend a liner. In many cases, liners are made of flexible plastic or rubber materials which are translucent.

Typical liners are provided with a variety of sleeves or other inlets or ports for access to the interior of the liners. These sleeves facilitate loading, venting, and unloading. In many cases, the loading and venting sleeves are placed in close proximity to one another yet distant from and above the unloading sleeve.

In some designs, the liner is made contiguous with at least a rear bulkhead, and the bulkhead then serves as a closure for the liner. In other designs, the liner may remain open on one or another of its faces.

All of the liners described above suffer limitations with regard to ease of installation and requirements for manipulation to prepare the liner to receive cargo. Most importantly, liners are needed which may be installed with a minimum of manpower and skill.

UNLOADING ASSISTANCE DEVICES

Unloading assistance devices are known in the art and include hoppers with fixed, rigid members providing advantageous angled corners for enhancing gravity flow of bulk cargo. In some cases, such hoppers are used with bottom unloading containers such as rail cars. In other instances, the rigid surfaces which form the unloading assistance device may be fixed in place, and in still others, the inclined surface may be pivotally attached to one or another support structure such as a bulkhead or container wall. In yet other designs, the inclined surface which promotes the unloading of corner spaces in the liner may be provided by particular arrangements of the bulkhead member itself. In this type design, the bulkhead may be placed either upright in a vertical position or angled to form an inclined plane to facilitate unloading.

In some designs, a bulkhead is modified to promote the unloading of the flowable cargo. Thus, the typically flat bulkhead may be replaced by a curved bulkhead providing a funnel-like surface to direct the flow of the cargo during unloading. Again, the typically flat bulkhead may be modified with rigid, planar corner members pivotally attached to the bulkhead to truncate the corners of the cargo space and thereby assist unloading of the corners. In the designs with altered corners or curved bulkheads, a substantial portion of the cargo space is sacrificed. Depending upon the design and the mass/packing density of the cargo, this loss of cargo space may represent up to several hundred pounds of material which could otherwise be transported.

Other designs to date have involved modifications of hoppers by addition of inflatable membranes to the wall of the hopper structure. Still other unloading assistance devices have involved forcing gases or liquids in between a container wall and the liner ("second-skin" type liner) to force bulk cargo to pour out of bottom portals. In yet other designs, liners or small container bags have inflatable and semi-pervious corner members which aerate and agitate the pulverant cargo contained in them by release of air into the flowable cargo. In yet other designs, a folded sheet is provided which, when stretched and unfolded, forms a slanted unloading surface.

Unfortunately, each of the systems for assisting the unloading of bulk cargo mentioned above suffers from one or more deficiencies. In some cases, for example, the unloading assistance device is necessarily attached to either the container or to the bulkhead which restrains the liner. In these cases, however, where a liner is to be used independently of either the container or bulkhead, as the case may be, it is not possible to take advantage of the unloading capability of the device. The same limitation applies to bladders attached to the hopper or container in which a liner is to be used to transport bulk flowable cargo. As mentioned previously, fixed corner-truncating devices substantially reduce the available cargo space. Unloading assistance devices are needed which overcome these and other limitations.

The deficiencies pointed out in the bulk cargo transport systems and elements of systems described above continue to limit the safety, efficiency and utility of such systems. Thus, a long-felt and unfulfilled need continues to exist for a bulk cargo unloading system which minimizes or substantially overcomes the variety of deficits in known designs.

SUMMARY OF THE INVENTION

In a preferred form, the invention comprises a cargo container for flowable cargo, which container includes a self-installing, inflatable liner, a transparent bulkhead, and one or more inflatable bags configured and positioned within the container to promote recovery of cargo from the container. The liner, like the bulkhead, is also preferably transparent in that it is either transparent or sufficiently translucent to enable a viewer to view the extent or disposition of cargo within the liner. The liner is also configured such that, upon inflation, it fills substantially an entire container. The liner has at least one port located near the top of the liner at one end of the liner—normally the rear end abutting a door or other access means to the interior of the container. This port may comprise a flexible tube or the like for venting the liner or for filling the liner with a cargo. At least one second port is also located near the bottom of the liner at its rear end to enable cargo to empty from the liner. A third port is located proximate the top of the front end of the liner and includes a compressible tube or other conduit which is designed to extend along and beyond the length of the liner for the purpose of inflating the liner. The compressible nature of the tube enables the tube to serve as a valve in that it is compressed and sealed upon inflation of the liner.

The liner is folded or otherwise arranged within a cargo container with its filling port toward the front end of the container. Then, as air or other suitable gas is passed into the liner through the filling port, the liner inflates, unfolds and ultimately fills the container. A flowable cargo is then passed through the filling port into the liner. As explained above, the liner ultimately seals itself.

To relieve pressure on the doors or other access means to the container, the invention preferably employs a bulkhead between the back end of the liner and the doors. The bulkhead extends across the container and to a height sufficient to relieve loading on the doors, especially the lower portion of the doors.

The inflatable bags of the invention are positioned in one or more of the corners at the rear end of the container between the liner and the container. Each bag includes a port or is otherwise structured to be inflated and deflated. Thus, air or other suitable fluid is injected into each bag when the liner is emptied to dislodge cargo which otherwise tends to be left in the container when the container is emptied. It is of course possible to cause as many cycles of inflation and deflation as necessary to fully unload the liner.

It will be recognized that each of the above features of the invention may be employed by itself with benefits to the user. It is preferred, however, that all three features be used in combination.

DETAILED DESCRIPTION

As noted above, the present invention relates in one aspect to a rigid bulkhead, at least a portion of which is transparent—i.e., either clear or sufficiently transparent as to enable viewing through the bulkhead. The rigidity of the bulkhead provides a principal advantage over prior art bulkheads which are flexible or at least yield under load to transfer the load to the doors or other opening means for the container. The materials from which the bulkhead is made are not so heavy as to require machinery or extensive manpower for installation. Thus, installation of a bulkhead of the invention has been demonstrated to be easily carried out by two persons.

The bulkhead may be constructed, in whole or in part, from transparent, rigid material which is: (1) sufficiently transparent to provide at least some view of the cargo space of the container including the lower corners nearest the bulkhead; and (2) rigid enough to help prevent any substantial portion of a load from bearing upon the bulkhead and other support structures from being transferred to the opening means (doors) of the container.

It has been found that loads in cargo container liners may impose pressure on the lower and most central portion of a bulkhead of about 600 pounds per square foot. On the other hand, the loads at the lower corners of a typical cargo contained behind a bulkhead may run about 400 pounds per square foot. At the topmost corners of such a load-bearing bulkhead, about 50 pounds per square foot are typically encountered. The bulkhead of the present invention counteracts such forces sufficiently to prevent transfer of the load to the rear container doors.

A preferred rigid, transparent bulkhead material is an acrylic resin sheet. However, it is anticipated that a variety of other materials are also suitable, including safety-reinforced glass, fiber reinforced plastic, structurally molded plastic, and other products which possess the necessary rigidity and transparency. As will become more apparent when the bulkhead is described in detail below, some portions of the bulkhead will not be required to be either rigid or transparent, so long as enough overall rigidity and transparency is retained by the bulkhead to provide the advantages of the invention. The overall bulkhead unit, however, should demonstrate both of these characteristics.

By making a bulkhead of the invention of a material through which the interior of the container and liner may be seen, the bulkhead overcomes a substantial limitation of opaque bulkheads or bulkheads with only limited capability to provide such a view. In a preferred embodiment, the bulkhead is clear thereby providing maximum visibility of the cargo space. In any case, the view provided by the bulkhead of the invention facilitates observation of the interior cargo space with relative ease compared with prior art devices. Thus, a preferred embodiment facilitates observation of important aspects of the bulk cargo transport system including: (1) installing of the liner; (2) loading of the bulk cargo; (3) viewing of cargo during transport; and (4) unloading of cargo.

This capability represents a substantial improvement over prior art devices and facilitates bulk cargo handling with reduced manpower requirements. For instance, automated machinery may be used in combination with liner systems for both loading and unloading to minimize handling by personnel of bulky or hazardous materials. Where such automated devices are utilized, the ability of a single handler to view the entire operation is enhanced. Cargoes may include any cargo such as pelletized plastic, grain, particulates, or other flowable cargoes.

The bulkhead of the invention is capable of being positioned between a liner and the opening means for a container. The opening means typically comprises a rear door or doors of the container. Alternatively, the opening means may be openings positioned along any wall of a container wherein an opening is found so long as the bulkhead may be adjusted to function as described above in conjunction with such opening.

Of independent significance, the bulkhead of the invention is capable of relieving the load caused by a cargo within a liner from being transferred directly to the opening means. The ability to restrain the load within the liner relies, in one aspect, upon the rigid and substantial construction of the bulkhead. In addition, the restraining ability relies on the special construction of the bulkhead itself, including the portions of the bulkhead which extend forwardly into the container cargo space. The restraining ability of the bulkhead is increased by a minimal use of structural support members.

Another important aspect of the bulkhead of the invention is that there is no requirement for any attachment to a liner used with the bulkhead. This represents a considerable improvement over those prior art bulkheads which are integral with the liner or which function as a closure for the liner. Such prior art devices do not facilitate use of the bulkhead separate from the liner. The present invention on the other hand uses discrete components. This is especially important in those countries where laws require either reusable shipping container liners or fully recyclable shipping container liners. Many commercially available liners are recyclable, but many bulkheads are not. Inasmuch as the bulkhead of the present invention is not attached to the liner, the bulkhead is fully reusable.

An inflatable air bag used in conjunction with a liner within a container is also a feature of the present invention. The air bag may take a number of configurations depending upon the unloading procedures being used. In a preferred embodiment, the air bag will be attached to the liner to facilitate the unloading of the residual cargo that remains following gravity flow unloading. However, in alternative embodiments, the air bag may be attached to other elements of the invention such as the transparent bulkhead or the container itself. In addition, air bags need not be attached to any of the other elements of the invention.

Regardless of whether attached or unattached, the air bag is positioned in close proximity to an outlet in the liner. The outlet in the liner is, in turn, positioned in close proximity to the opening means in the container, usually the rear doors.

A self-installing liner capable of containing bulk cargo and separating the cargo from the interior surfaces of a bulk cargo container is also a feature of the present invention. The term "self-installing" means a liner which requires minimal manpower and manipulation for installation and preparation for receiving bulk cargo. More particularly, the self-installing liner of the present invention requires only attachment of the liner to the forward container wall, thereafter relying on forced air inflation of the liner to fully install the liner within the container. Attachment of the liner to the forward container wall is achieved with minimal manpower as well. In one embodiment, the folded liner is placed in the front of the container in a manner exposing a top and bottom edge of the front panel of the liner. In this embodiment, the bottom edge of the front panel is manually attached near the forwardmost container floor with attachment being achieved by nailing, tacking or by applying adhesive. Next, the top edge of the front panel of the liner is attached to a forwardmost container wall or ceiling in a manner to fully extend the front liner panel. The attachment of the top edge of the liner may be by means of a nailing or hanging board or by means of hanging straps looped over a lash bar in the container. In another embodiment, attachment of the liner to the forward container wall and floor portions is achieved with even less manpower or manipulation. In this embodiment, the bottom edge of the front panel of the liner is previously attached to a packaging member. The packaging member comprises at least two panels the outer surface of which panels are coated with an adhesive which adhesive-coated, outer surface is additionally covered with a removable release paper or sheet. Instead of requiring a manual attachment of the bottom edge of the front panel, installation of this embodiment of the invention merely requires removal of the release paper exposing the adhesive-covered panels. These panels are then placed in the front most corner of the container where floor and front wall members join. If greater than two panels comprise the package member, these panels may be unfolded to additionally adhesively attach to the container wall or floor. The top edge of the forward panel of the liner is next attached as noted above. Upon inflation, as described below, the adhesive covered panels of the package member become even more firmly attached to the container. This attachment is enhanced when bulk cargo is placed in the liner. After the front panel of the self-installing liner is attached, inflation is initiated. This is achieved, in a preferred embodiment, by providing an inflation tube for filling with gas the deflated liner. In certain embodiments, this gas will be compressed ambient air, either filtered or unfiltered. In other embodiments, especially where inert gases are preferred due to an explosive, combustible or otherwise reactive nature of certain cargo or due to the need for maintaining low moisture content of the inflating gas and cargo, gases other than air may be used.

A surprising attribute of the invention lies in the lack of necessity for a means to close the inflation tube to prevent gas from escaping from the liner. The position of the inflation tube is such that upon continuing inflation, the liner presses against the inflation tube, progressively causing enough pressure against the inflation tube to effectively seal the liner from losing internal air. Thus, the self-installing liner may be inflated inside a container and bulkhead as much as two days prior to being loaded. This added flexibility in operation provides a considerable advantage.

An additional surprising aspect of the self-installing liner is its automatic inflation limitation feature when using certain forced-air equipment. As the inflation tube delivers the forced air into the liner, the inflow and outflow of air equilibrates to prevent over inflation of the liner and potential rupturing of the liner material. Thus, there is no requirement when using certain forced air equipment, such as a small centrifugal blower as might be found on home leaf-blowing equipment, to monitor a self-installation for possible over inflation. Hanging strap means are provided at the top edge of the rear panel of the liner for positioning and hanging of the liner once the self-installation is achieved.

The overall self-inflation features of the liner of the invention represent a substantial improvement over conventional systems for installing liners. The self-installing liner employs a relatively few, simple steps for deployment, compared with conventional liners which use numerous straps, belts, hooks, attached bulkheads, adhesives and the like. Although certain limited use may be made of attachment devices such as these in conjunction with the self-installing liner, such use is kept to a minimum.

The various elements described above individually represent considerable improvements over the existing art. However, they may also be combined in a number of ways to achieve even further improvements. In that regard, it is contemplated that the systems of the invention will be used in connection with a typical walled container having at least side walls, front and rear walls, and a floor. However, the apparatus and methods of the invention may also be applied to cylindrical containers or other irregularly shaped containers. The container should have at least one wall with an opening through the wall to provide access to the interior of the container. This opening in many instances will comprise the rear doors of a container. At the present time, most containers are being configured to provide rear door access to the cargo compartment; and this description, accordingly, has generally assumed that type of access.

Each system of the invention will have a liner capable of containing bulk cargo and capable of providing a barrier between the cargo and the interior surfaces of the container. In a preferred embodiment, the liner is constructed of lightweight, flexible materials known well in the art. In alternative embodiments, the liner may be constructed of heavier, more durable materials where multiple uses or the characteristics of the cargo so require.

Where the liner is to be used with a bulkhead which does not extend the full height of the container, such as where only a lower portion of the container opening is provided with a rigid and transparent bulkhead, the face of the liner which will encounter the bulkhead and supporting bracing structures may be reinforced with multiple layers of liner material or with a more substantial plastic material. In a preferred embodiment, even with reinforcement as necessary, the liner should be sufficiently transparent to provide a view into the interior of the liner.

Preferably, the liner will be constructed of a material through which the cargo may be clearly seen. Moreover, in a preferred form, the liner will be constructed to fill, upon complete installation, the space defined by the interior walls of the container.

It will be apparent to those of skill in the art that the bulkhead of the present invention may be used with a wide variety of containers, container liners, and opening mechanisms. Thus, many commercially available containers, fitted in a variety of ways with opening means, may be used in combination with the transparent and rigid bulkhead. Likewise, many commercially available liners may be adapted for use with the bulkhead.

It is contemplated that the inflatable bags of the invention will be placed at positions within a lined container, wherever cargo tends to be left behind when the liner is emptied. Thus, when a container is tilted to drain cargo from a liner through an outlet port or a container door, cargo frequently remains along the outlet end of the container, and especially in the corners of the container. It is, therefore, preferred that the outlet of the liner be positioned in close proximity to the bottom of the container and also in close proximity to the opening means in the container. Inflatable bags placed in the corners at the outlet end of the container may then be most effectively used to promote the unloading of cargo within the liner. As mentioned above and as is required by any particular bulk cargo handling situation, the inflatable bags may be variously attached to the liner, the bulkhead or the container. Alternatively, the bags may be entirely separate members, unattached to any of the other elements. The air bags need not be uniformly sized, particularly where asymmetry in the position of the opening means in the container and the outlet in the liner require differently sized air bags.

Inflation of the bags may be achieved in a variety of ways. One embodiment involves the use of filler tubes to which may be attached a source of pressurized air or other suitable gas or fluid. It is necessary, of course that the pressure of the gas be sufficient to inflate the bags when covered by cargo material. It is also necessary that the bags, when inflated, have a shape, size and slope sufficient to cause the cargo to flow toward the outlet. Where the cargo is relatively lightweight, centrifugal blowers may provide sufficient pressure. When the container is used in facilities without access to electrically powered compressors, blowers, pumps or the like, compressed gas tanks may be packaged with the other elements of the apparatus.

It will be apparent that the use of the inflatable bags of the invention is not limited to the specific liners and bulkheads of the present invention. Thus, the bags may be used with any bulkhead or container and used effectively with any of a number of liners known in the art. The bags may also be attached to the liners, themselves, or to a baseboard or to elements of the containers.

The self-installing liners of the invention may be used in conjunction with virtually any known cargo container, bulkhead, opening means, and the like. However, their use with the rigid and transparent bulkheads and the inflatable bags of the invention provide particular benefits. Thus, in a preferred embodiment, a rigid and transparent bulkhead, fitted into a container with a self-installing liner and inflatable unloading assistance devices, provide especially safe and efficient transport of bulk flowable cargo. Although the elements discussed above may be provided and shipped separately, they may also be packaged as a unit. Additionally, where it is desirable to do so, a facade which covers the apparatus of the invention may be provided for purposes of identifying the source, the nature, the required handling procedure and other pertinent information relating to the apparatus and its use.

Methods for transporting fluid or fluidizable bulk cargo are also achieved by the use of one or more of the elements of the invention. These methods generally require selecting an appropriate apparatus as provided by the invention and matching it with a particular bulk cargo, transporting the bulk cargo therein, and then unloading the cargo in a manner to take advantage of the considerable improvements in safety and efficiency provided by the present invention. The specific improvements available when one or another of the elements, alone or in combination with one or more of the other elements of the invention, is also claimed. Thus, where safety and viewability of the cargo space are of importance, one would select a method of transporting the cargo utilizing at least the rigid and transparent bulkhead of the present invention. Where efficiency and low manpower requirements are important, one would select a method where at least the self-installing liner of the present invention is used. Where efficiency and the need to remove residual cargo left after unloading are important, a method which at least uses the air bags of the present invention is preferred.

DESCRIPTION OF DRAWINGS

In general, the figures depict the construction of the various elements of the liner-bulkhead-corner bag system of the invention including alternative packaging systems therefor. The figures also illustrate the self installation of a liner with alternative attachment means therefor. Certain figures are included to show the fully installed liner-bulkhead systems within containers. Finally, figures are included which illustrate the unloading of cargo from a liner within a container. Although not depicted in the figures to follow, it will be understood by those of skill in the art that certain commonly encountered elements may be used in conjunction with the elements of the invention.

Thus, the elements of the invention will typically be used with containers used in transportation and commerce such as those seen carried on truck beds, rail cars and in vessels. In some instances, these means of conveyance will include means for tilting the container for unloading of the contents therein. It will be readily apparent from the disclosure herein that the elements of the invention may be used to advantage in such containers. It will also be readily apparent that certain modifications of the current invention may be necessary to accommodate the variety of container systems available. These modifications are, as will be apparent to one of skill in the art, intended to be included within the scope of the claims of the present invention.

Figure 1:
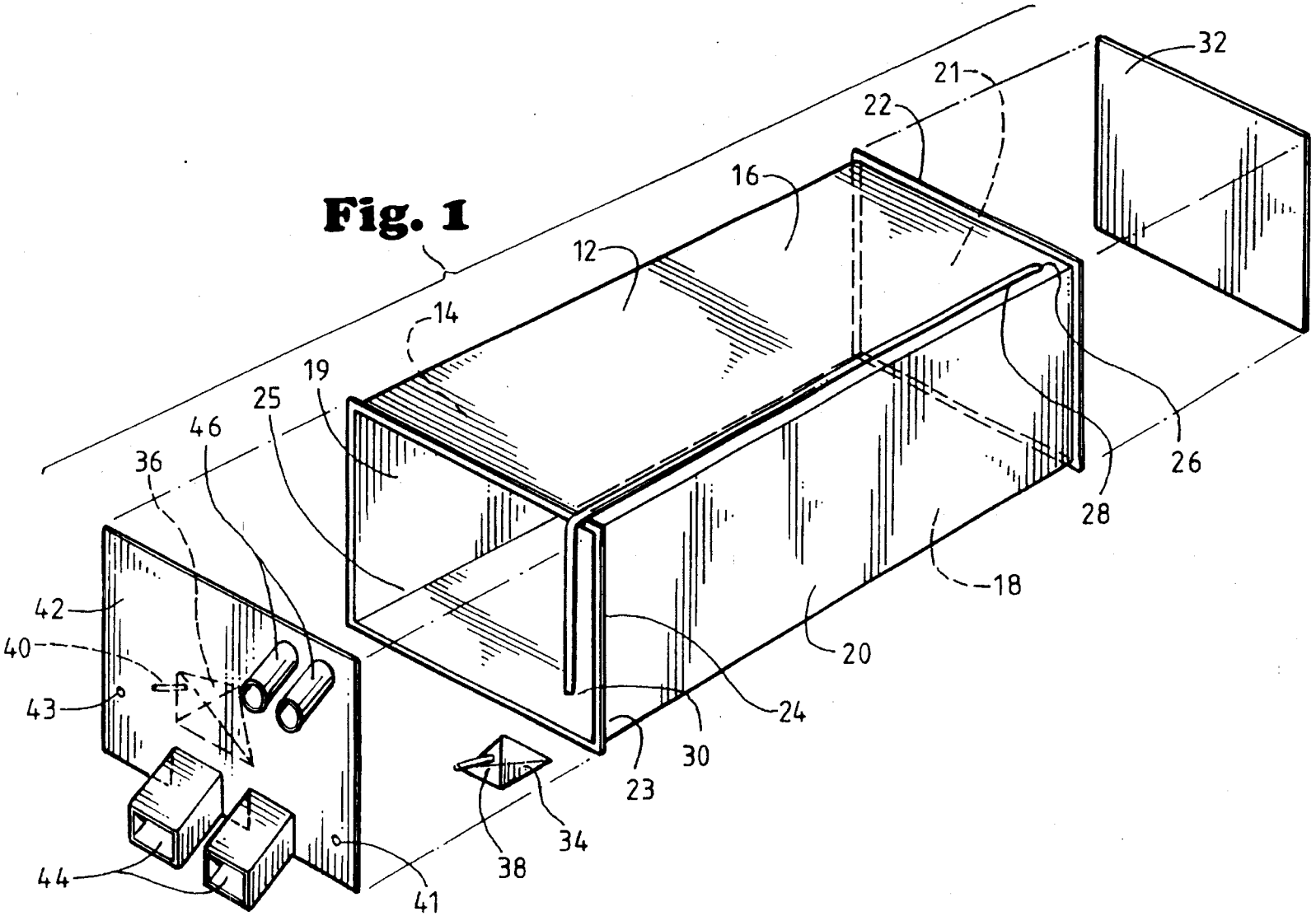
FIG. 1 is an exploded, isometric view of the construction of a self-installing liner system.

Turning first to the construction of the various elements of the invention, FIG. 1 shows construction of a self-installing liner system which comprises an appropriately sized tubular section 12 with upper panel 16, side panels 14 and 20 and lower panel 18. Panel construction is selected in accordance with the specifications of the container in which the liner is to be used and dimensions of such panels generally conform to the internal dimensions of the container. Materials generally used for construction of tubular sections such as 12 include polyethylene but may also include in special circumstances vinyl film or plastic-coated fabric. Tubular section 12 is further provided at the front open end 21 and again at the rear open end 19 with flared lip members 22 and 24, respectively, along each of the four panels 14, 16, 18, 20 of tubular section 12.

Tubular section 12 is also provide with an aperture 26 to which is attached a tubular conduit 28. Tubular conduit 28 is typically constructed of polyethylene, vinyl film, plastic-coated fabric and extends from the aperture 28 near the front open end 21 along the entire length of tubular section 12 and sufficiently past rear open end 19 of tubular section 12 to allow facile access to end 30 of the tubular conduit 28 for applying a source of inflating gas or liquid.

Preferably, corner bags to facilitate unloading as described herein are placed inside the tubular section. Construction of such corner pieces is described more fully below in conjunction with FIG. 2A and B, but attachment of the corner bags to the inside corners 23 and 25 is accomplished to provide corner bags 34 and 36 with an airtight seal against the walls of the tubular section 12. Corner bags 34 and 36 are further fitted with inflation tubes 38 and 40, respectively, to provide a means of inflating and deflating the respective corner bags.

End panels 32 and 42 are provided for fixed attachment in an airtight manner to the open ends 19 and 21 of tubular section 12. The rear panel 42 is typically provided with a number of apertures and sleeves to facilitate access to the interior of the liner. Selection of the numbers, sizes and placements of the various apertures is dependent upon the type of cargo and container to be transported. However, most uses will require apertured sleeves for loading and venting such as sleeves 46 attached near the upper edge of rear panel 42. These sleeves are typically selected to fit standard sized loading and venting equipment well known to those of skill in the art of container liner construction. Similarly, apertured sleeves for unloading such as sleeves 44 will be attached near the lower edge of rear panel 42. In some cases, more than one sleeve will be provided (as here), while in others only a single unloading sleeve will be provided (as in FIG. 3 below). Numbers, sizes and placement of such sleeves are again dependent upon the job to be accomplished. Other apertures and fixtures may be provided in the rear panel 42 such as apertures 41 and 43 for access to inflation tubes 38 and 40, respectively, of corner bags 34 and 36, respectively. Fixtures such as loops, straps, hooks, ropes, nailing boards, adhesive straps, reinforcing strips and the like (not shown in this figure) may be attached to the end panels as needed.

End panels such as 32 and 42 are typically constructed from polyethylene, vinyl film or plastic-coated fabric. In preferred aspects, the rear panel 42, at least, will be constructed of sufficiently transparent materials to allow viewing of the interior of the liner. In a finishing step, end panels 32 and 42 are attached in an airtight manner to tubular section 12 along flared lips 22 and 24, respectively. The self-installing liner of FIG. 1 is depicted in a completed state in FIG. 3.

Figure 2A:
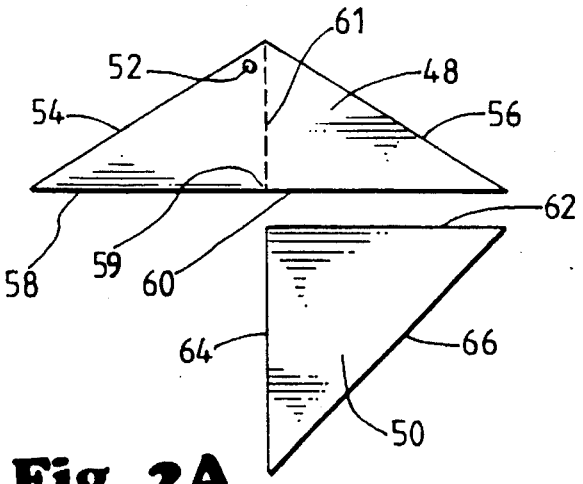
FIGS. 2A and B show construction of a corner bag.

FIGS. 2A and B show construction of a corner bag. In FIG. 2A, two workpieces 48 and 50 are shown which are attached as follows to produce the space-filling corner bag depicted in FIG. 2B. Workpiece 48 is an isosceles triangular piece which may be fashioned from polyethylene, vinyl film, plastic-coated fabric or similar materials. Workpiece 48 has equilateral sides 54 and 56 forming an edge at their intersection whose position 61 above the base of the triangular workpiece coincides with a point 59 which transects the base of the workpiece 48 into two equal sections 58 and 60. Workpiece 48 is further provided an aperture 52 in the upper corner near the point at which sides 54 and 56 intersect. Workpiece 50 in FIG. 2A is an isosceles triangular workpiece of similar material to workpiece 48 and has equilateral sides 62 and 64, and a base side 66.

Figure 2B:
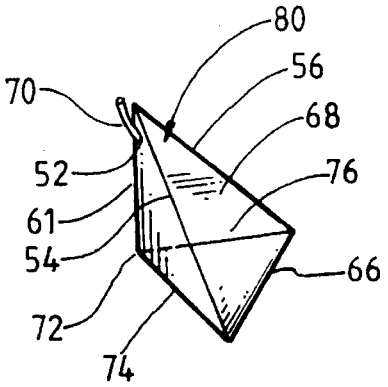

The following pairwise sides are attached one to the other to form airtight seals: section 60 is attached to side 62 to form side 76 of FIG. 2B; side 58 is attached to side 64 to form side 74 of FIG. 2B. The resulting space-filling, tetrahedrally-shaped bag 80 comprises an open face 68 opposite a right triangular corner 72. The open face of the tetrahedral bag may be attached to a third workpiece matching the first two to produce a freestanding closed bag; or the open face may be attached in an airtight manner to a surface of a liner as shown in FIG. 1. In either case, a final installation of an inflation tube 70 attached at aperture 52 completes the construction.

Figure 3:
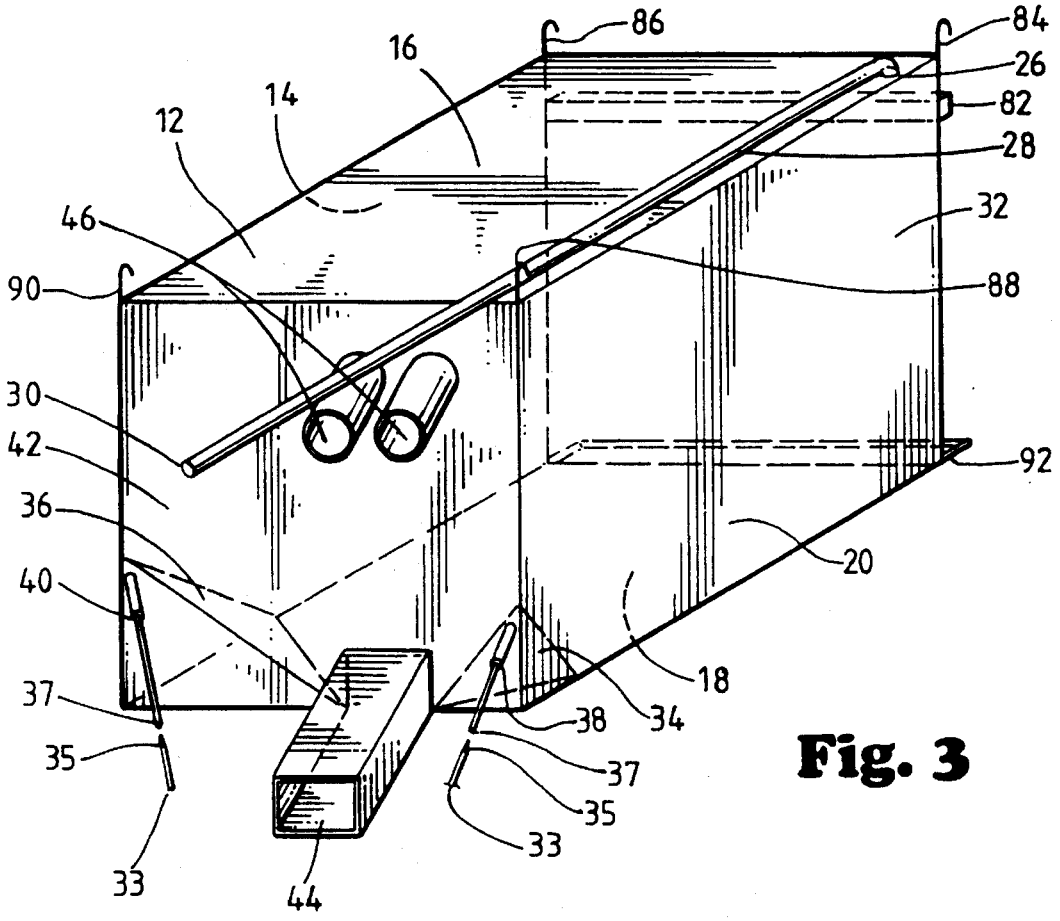
FIG. 3 is an isometric view of a completed liner system.

FIG. 3 is an isometric view of a completed liner system. Tubular section 12 comprising side panels 14, 16, 18 and 20 is attached to rear panel 42 and front panel 32. Inflation tube 28 is attached to aperture 26 and extends past rear end panel 42 to end 30. Rear end panel 42 is fitted with upper loading and venting sleeves 46, lower unloading sleeve 44, inflation tubes 38 and 40 providing inflatable access to corner bags 34 and 36, respectively. Inflation tubes 38 and 40 are fitted with a standardized valved tube 37 for fitted attachment to standard sized nozzle 35 providing means for delivering the inflating gas or liquid 33 into the corner bag. Rear end panel 42 is further fitted with hanging straps 88 and 90. Front end panel 32 is further fitted with hanging means including nailing board 82 and hanging straps 84 and 86. Lower attachment means 92 are also provided and may consist of a nailing board, an adhesive strip, or a means of attachment as shown in FIG. 7.

The completed liner as shown in FIG. 3 may be deflated and folded to facilitate inflation and unfolding. Furthermore, it is possible with a liner folded in such a manner, to easily package the liner with other elements such as bulkheads, support members, attachment members, and the like.

Figure 4A:
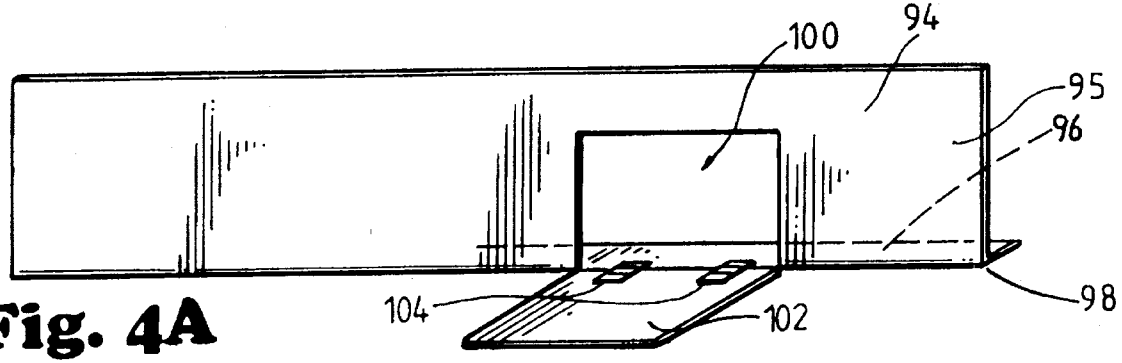
FIGS. 4A–D are isometric views of rigid bulkheads.
Figure 4B:
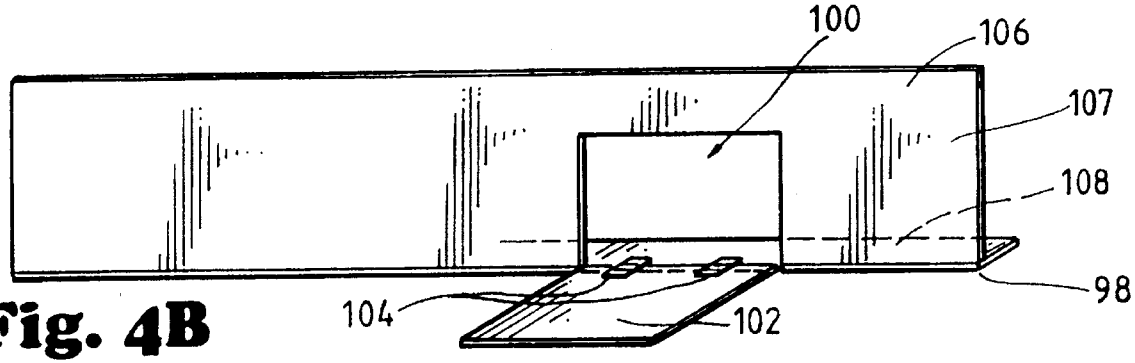
Figure 4C:
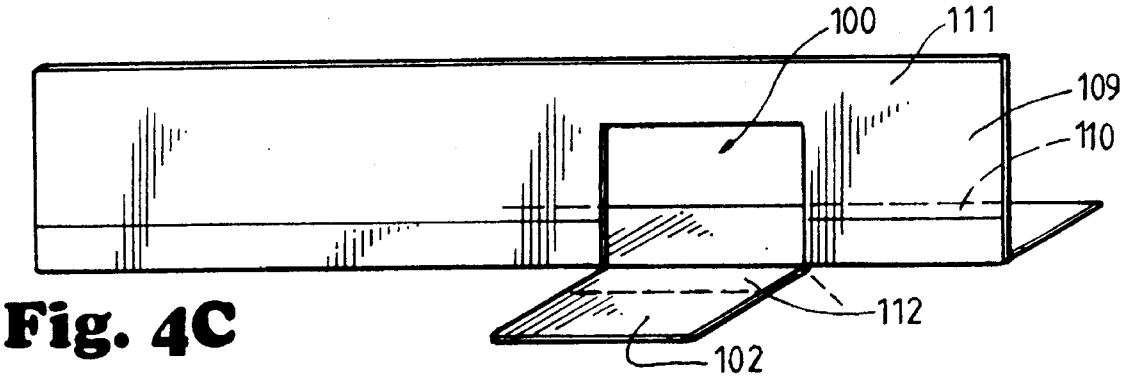

FIGS. 4A–C are isometric views of rigid, transparent bulkheads of the invention. FIG. 4A depicts a bulkhead 94 the length dimension of which corresponds to the dimension required to approximately span the rear opening of a container. Bulkhead 94 is constructed of a rigid and transparent material according to the details provided in the disclosure above. In this case, a 90 degree bend at 98 is induced in the bulkhead material which causes a horizontal return panel 96 to horizontally return in the direction of the interior of the container. Vertical bulkhead panel 95 and horizontal return panel 96 are contiguous and preferably formed of the same initial workpiece. An aperture 100 is provided in bulkhead panel 95 which is closeable by door 102 hinged to horizontal return panel 96 by hinges 104. Other apertures may be provided in vertical bulkhead panel 95, where necessary, such as for inflation tubes providing inflatable access to corner members (not shown).

In FIG. 4B, bulkhead 106 provides similar aperture 100 closeable by door 102 hinged to horizontal panel 108 by hinges 104. However, in this embodiment, bulkhead panels 107 and 108, while adhesively made contiguous one to the other, are not constructed of the same workpiece bent to produce a 90 degree return at point 98.

Figure 4D:
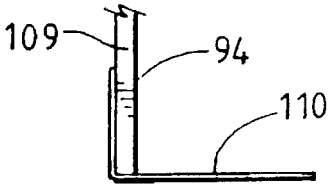

In FIG. 4C, rigid bulkhead 111 comprises a rigid and transparent vertical panel member 109 and a flexible sheet material 110 adhesively attached thereto to provide the horizontal return panel. Aperture 100 in panel 109 is similarly closeable by door 102. However, in this embodiment, hinged attachment of the door to the bulkhead is achieved through adhesive attachment to flexible sheet material 110 along joint 112. A partial sectional end view of the bulkhead depicted in FIG. 4C is shown in FIG. 4D.

Figure 5:
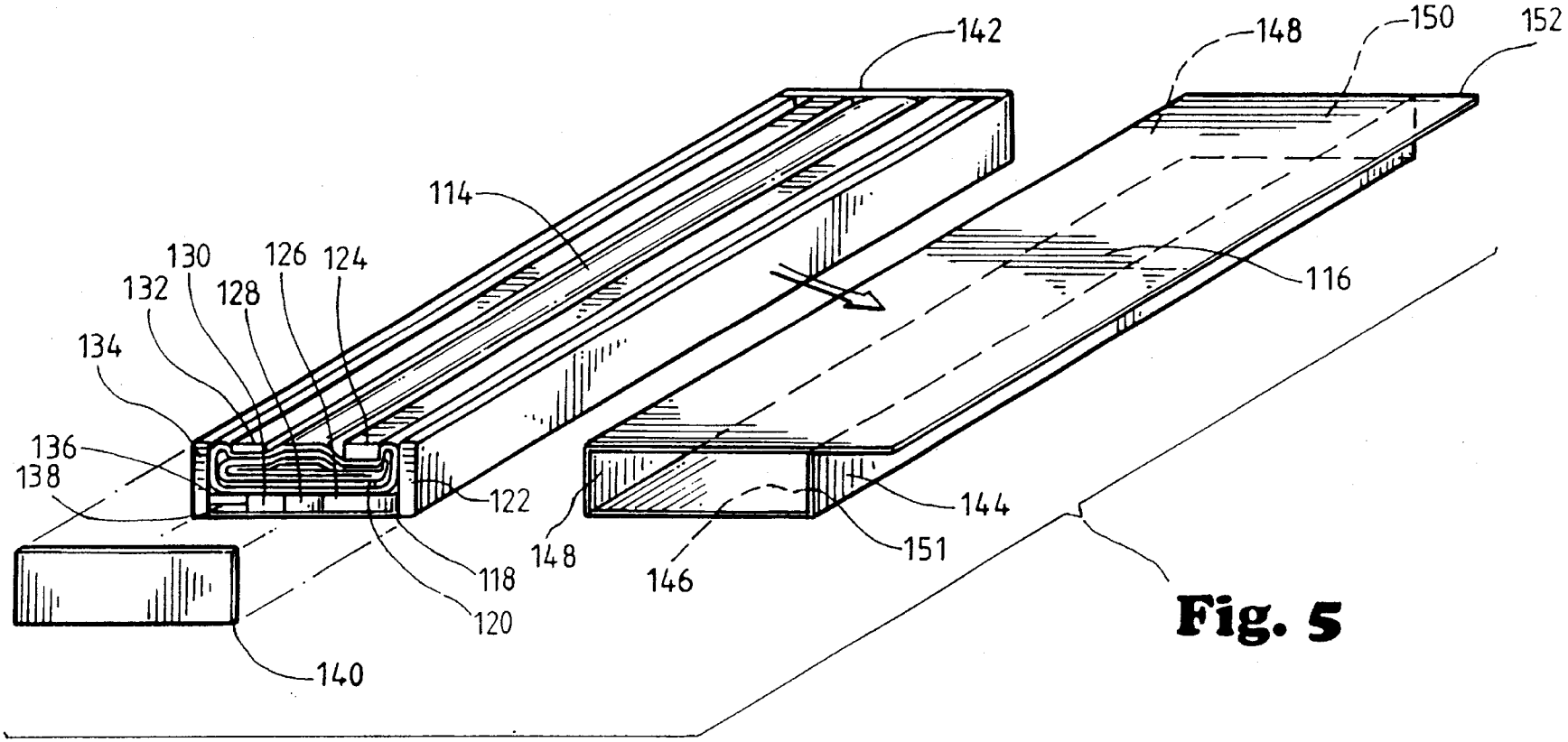
FIG. 5 is a partially exploded view of a liner apparatus packaging system.

FIG. 5 is a partially exploded view of a liner apparatus packaging system. A packaged bulkhead, liner and bracing unit 114 is illustrated which is insertable into a 6-paneled package 116. Bulkhead 118 serves as a base upon which bracing members 126, 128, 130, 136 and 138 immediately rest. On either side of the bulkhead are placed additional bracing members 122 and 134. The overall height of the bulkhead combined with the width of each of members 122 and 134 establish the minimum width of the package member along panels 148 and 150. End cap members 140 and 142, the height of each being equal to the height of the bracing members 122 and 134, establish a minimum depth for the package member 116. Deflated and folded liner 120 is placed in the receptacle formed by the bulkhead and bracing members and is additionally retained by bracing members 124 and 132. The entire unit 114 is then placed inside package member 116, which package member includes side panels 144 and 148, end panels 150 and 151, bottom panel 146 and top panel 152. Package member 116 may be constructed of any suitable material such as scored corrugated paper sheet. Top panel 152 is closeable to seal the contents of the package member.

Figure 6A:
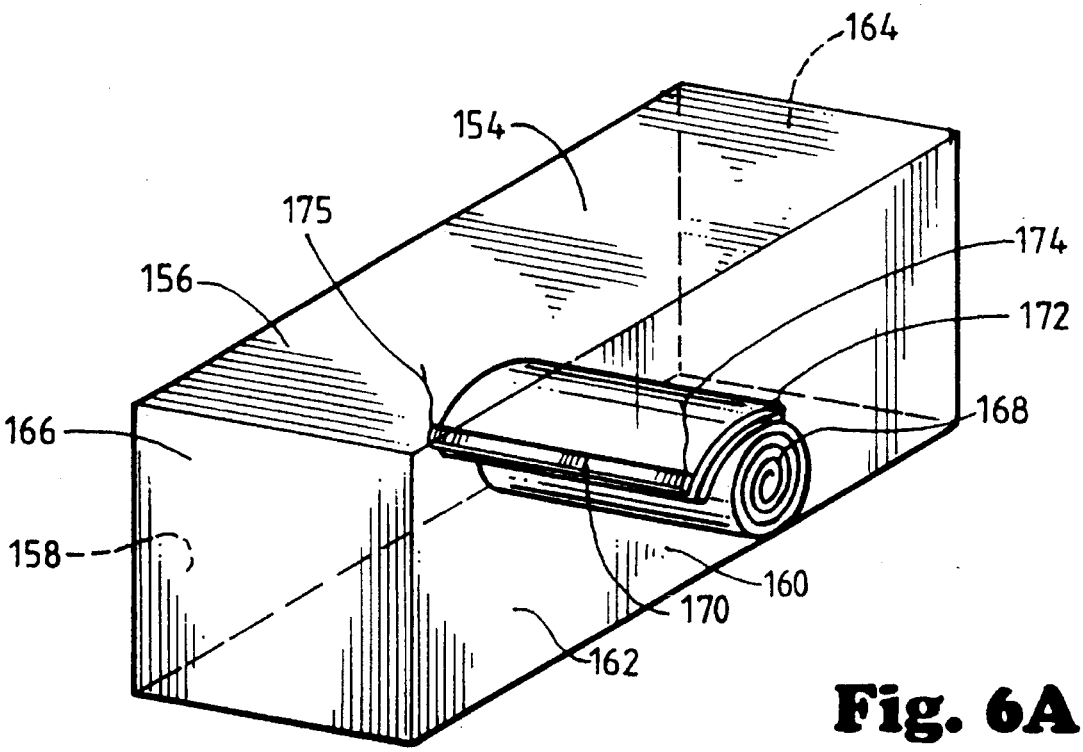
FIGS. 6A–D are stepwise, isometric views of a phantom container showing the stepwise self-installation of a liner within the container.

FIG. 6A–D are stepwise, isometric views of a phantom container showing the stepwise self-installation of a liner within the container. Turning to FIG. 6A, a deflated and coiled or folded, self-installing liner 168 is placed inside a container 154 depicted here in phantom with top wall 156, side walls 158 and 162, bottom wall 160, front wall 164 and rear wall 166 (as described herein, preferably comprising right and left hand doors for gaining access to the container). Initial placement of liner 168 is near the front wall 164. Liner 168 is partially unfolded to expose top edge attachment devices, such as, nailing board 170 and hanging straps 174 and 175, as well as bottom edge attachment device 172. The attachment devices are provided on the outer face of the front panel of liner 168 as shown in previous figures.

As shown in FIGS. 6A–D, liner 168 is configured, upon inflation, to fill the container 154. Thus, the liner 168 has end walls, side walls, top wall and bottom wall formed in a manner to fit within container 168.

Figure 6B:
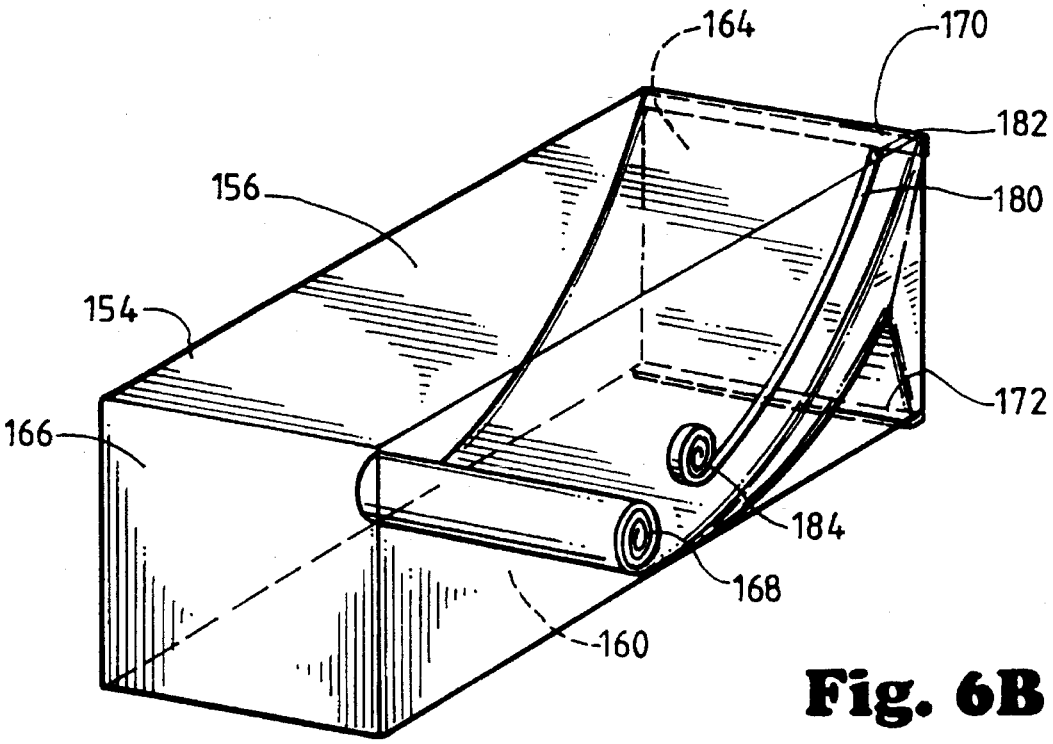

As a second step, shown in FIG. 6B, the bottom edge attachment device 172 is attached to the frontmost corner at the junction of container rear wall 164 and bottom wall 160. Similarly, top edge attachment devices, such as, nailing board 170 and hanging straps 174 and 175 (not shown) are attached to the frontmost corner at the junction of container rear wall 164 and top wall 156. These attachments result in the front panel of liner 168 being fully extended in close proximity to container front wall 164. Furthermore, as can be seen in the FIG. 6B, attachment results in a further partial unfolding of the liner 168 to expose aperture 182 and inflation tube 180. Inflation tube 180 is then fully extended from the front of the container to a point outside the container past the rear wall thereof to facilitate inflation of the self-installing liner through inflation tube end 184.

Figure 6C:
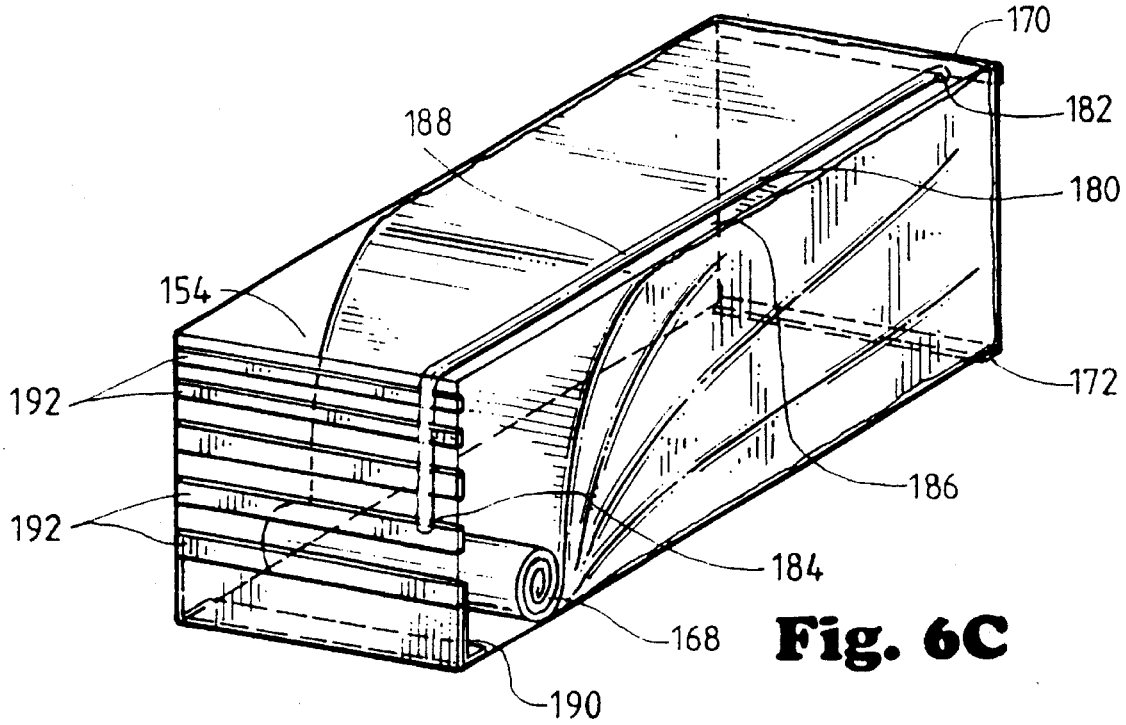

In FIG. 6C, it can be seen that bulkhead 190 has been installed using structural support members (bracing) 192. Inflation tube end 184 serves as a means for passing air via inflation tube 180 and into the self-installing liner 168 at aperture 182 (air inflation flow proceeds from end 184 toward aperture 182). Inflation tube end 184 is also shown to extend past the bulkhead 190 and structural support members 192 past rear wall 158 of the container 154. As can be seen in the figure, as air passes into liner 168, further unfolding occurs causing the liner to fill the space delimited by the container walls in a manner progressing from frontmost container space to rearmost container space. Inasmuch as liner 168 does so occupy the space within container 154, inflation tube 180 becomes increasingly constricted between the liner's upper panel and the container's upper wall as shown between point 186 along the container's top wall 156 and point 188 along the liner's upper panel. The constriction so produced is designed to allow complete inflation and self-installation of the liner; however, the constriction also serves to eventually seal off air flow from inside the container back along the inflation tube which would result in deflation.

Figure 6D:
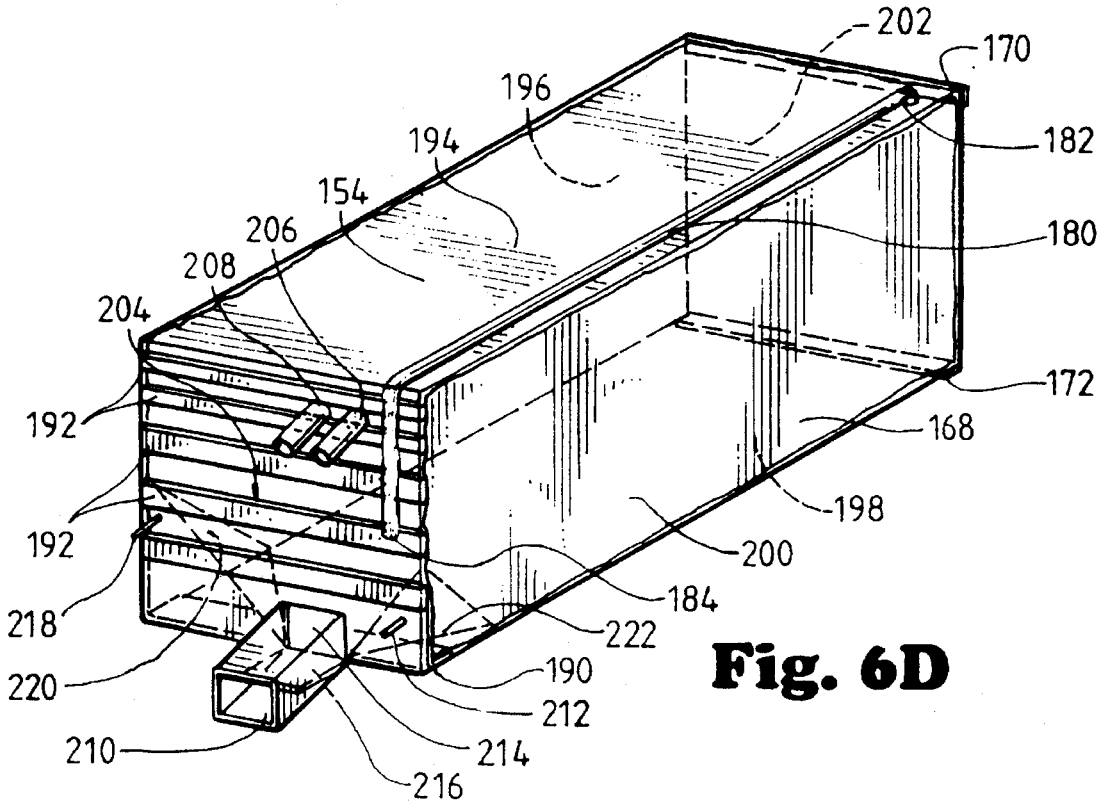

Turning now to FIG. 6D, it can be seen that the self-installing liner 168 fully occupies the container 154 interior space fully exposing liner top panel 194, side panels 196 and 200, bottom panel 198, front panel 202 and rear panel 204. The fully exposed liner panels conform in general to the interior space and dimensions of container 154. Along rear panel 204, the liner is contained by bulkhead 190 and support bracing 192. Full exposure of rear panel 204 further provides access to the loading sleeve 206, venting sleeve 208, unloading sleeve 210, corner bag inflation tube 212 (attached to corner bag 222), and corner bag inflation tube 218 (attached to corner bag 220). In this particular construction access for inflation tube 212 and for unloading sleeve 210 is provided through bulkhead 190. Unloading sleeve 210, for instance, is directed from inside the container spaces through aperture 214 in bulkhead 190 after opening the hinged door member 216. It is expected that both the bulkhead and the bracing members will be adjusted accordingly to provide access to all such sleeves and tubes as required. At a time just prior to full inflation, the nearly inflated liner may be adjusted to fit the container space by means of hanging straps near the top edge of rear panel 204 (not shown here).

Figures 7A, 7B, 7C:
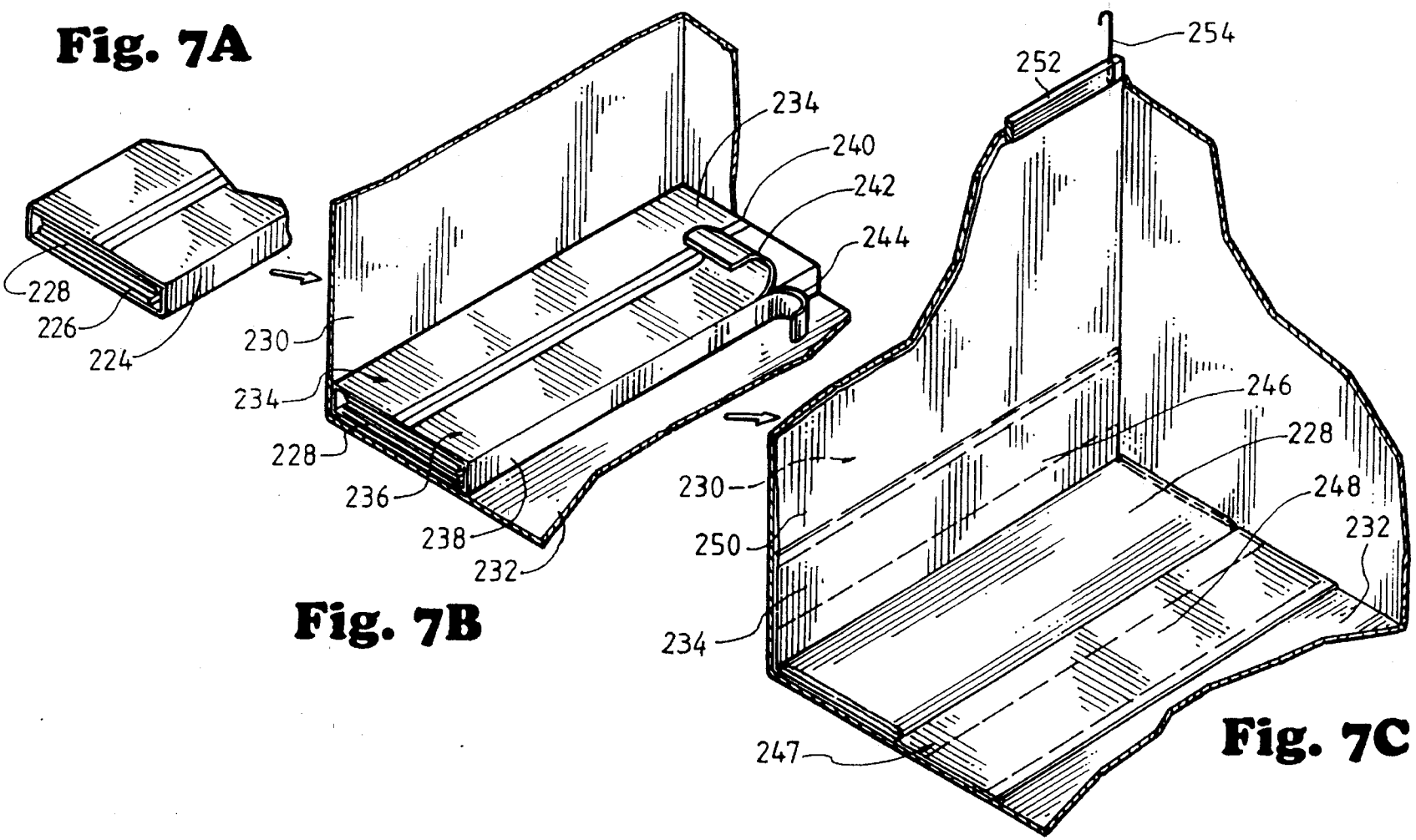
FIGS. 7A–C are stepwise isometric views, partially sectioned, showing an alternative packaging and attachment system used in conjunction with the self-installing liner.

FIG. 7A–C are stepwise isometric views, partially sectioned, showing an alternative packaging and attachment system used in conjunction with the self-installing liner. FIG. 7A illustrates a fragment of an alternative packaging and attachment means 224 containing bulkhead 226 and self-installing liner 228. Package 224 may be constructed out of any suitable material such as scored corrugated paper sheet material or the like.

Referring to FIGS. 7A–C, package 224 is introduced into a container as depicted by the arrow, and placed in the forwardmost corner at the junction of front container wall 230 and bottom container wall 232. As can be seen, the length of package 224 corresponds approximately to the width of the container. Box sealing tape 240 is removed from an outer surface of package 224 thereby allowing panels 234 and 236 to swing freely through an arc of at least 90 degrees and expose the interior of package 224. The bulkhead 226 is removed from the package 224 and placed aside for installation near the rear of the container as described previously. Adhesive-backed release tape (for example, those tapes shown being removed at 242 and 244), which completely covers the surfaces of panels 234, 236 and 238, is removed to expose the adhesive coated surfaces of the panels.

Panel 234 with adhesive outer surface 246 is brought into contact with the inner surface of container front wall 230 and adhesively attached thereto. Similarly, panels 236 and 238 with adhesive outer surfaces 248 and 247, respectively, are brought into contact with the inner surface of container bottom wall 232 and adhesively attached thereto. Front panel 250 of liner 228 is next attached by means of nailing board 252 or hanging straps (such as 254) as previously described. Self-installation of the liner may then proceed as described in FIG. 6.

Figure 8:
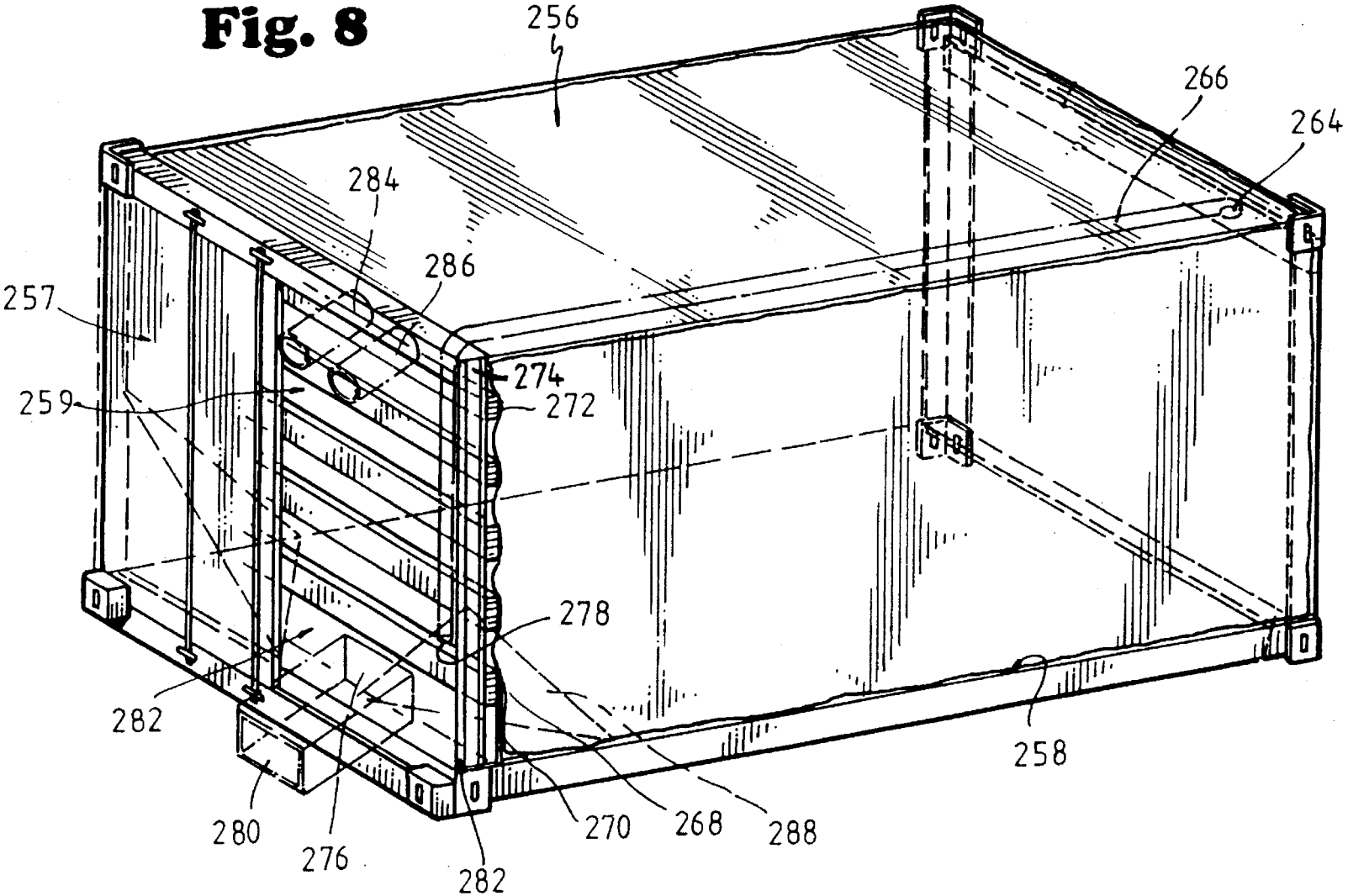
FIG. 8 is an isometric view of a self-installing liner with corner bags, transparent bulkhead and structural support members installed within a container.

FIG. 8 is an isometric, partially sectioned view of a self-installing liner with corner bags, transparent bulkhead and structural support members installed within a container. In the view provided here more detail is shown concerning the positioning of the self-installing liner and the viewability of the internal portions of the liner and container space through the transparent bulkhead and liner. Container 256 typifies the containers used to ship bulk cargo and includes rear doors of which only the left door 257 is shown in this view for simplicity. Liner 258 is shown fully inflated but not loaded with cargo. Inflation of the liner and the self-installation that results was achieved as described before by attaching a source of forced air to inflation tube end 278 and directing air flow through inflation tube 266 and into the interior portions of the liner via aperture 264. When fully inflated in this manner, the pinching or collapsing of inflation tube 266 serves to seal air inside the inflated container. Liner rear panel 259 can be seen to be contacting the horizontal structural support members such as 272 which are in turn spaced conveniently by interval attachment to vertical structural support member 274. Spacing of the structural support members may be adjusted to accommodate attachments to the rear liner panel 259 such as for loading sleeve 286, venting sleeve 284 or inflation tube 266.

As illustrated, internal portions of both the liner and the container space are visible through both the rear liner panel 259 and the transparent bulkhead 270. The view is possible even through both the bulkhead 270 and the liner at position 268. This degree of viewability which encompasses virtually all of the interior portions of the liner and container is an important aspect of the invention. Access 276 is provided in the bulkhead 270 for unloading sleeve 280. Importantly, it is possible to see the corner bag 288 (shown here in a deflated condition) through the bulkhead 270 and liner rear panel at position 268. This ability becomes crucial when using the corner bag to unload residual cargo on the corners after gravity flow unloading.

Another important aspect of the liner-bulkhead design of the current invention is the manner in which the bulkhead and support members prevent the load exerted by the cargo within the liner from being directly transferred to the rear doors. Spacing 282 between the rear door 259 and any element of the bulkhead, structural support members or liner is provided to help insure no portion of the bulkhead liner system transfers a load directly to the rear doors. As will be shown in FIG. 9 to follow, all load is transferred via the bulkhead and bracing to the container at a position forward of the rear door posts of the container (not shown here).

Figure 9A:
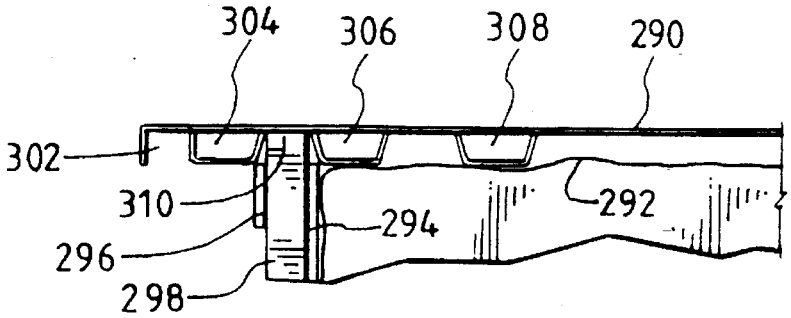
FIG. 9A is a partially sectioned top view of a transparent bulkhead installed within a container with structural support members and liner.
Figure 9B:
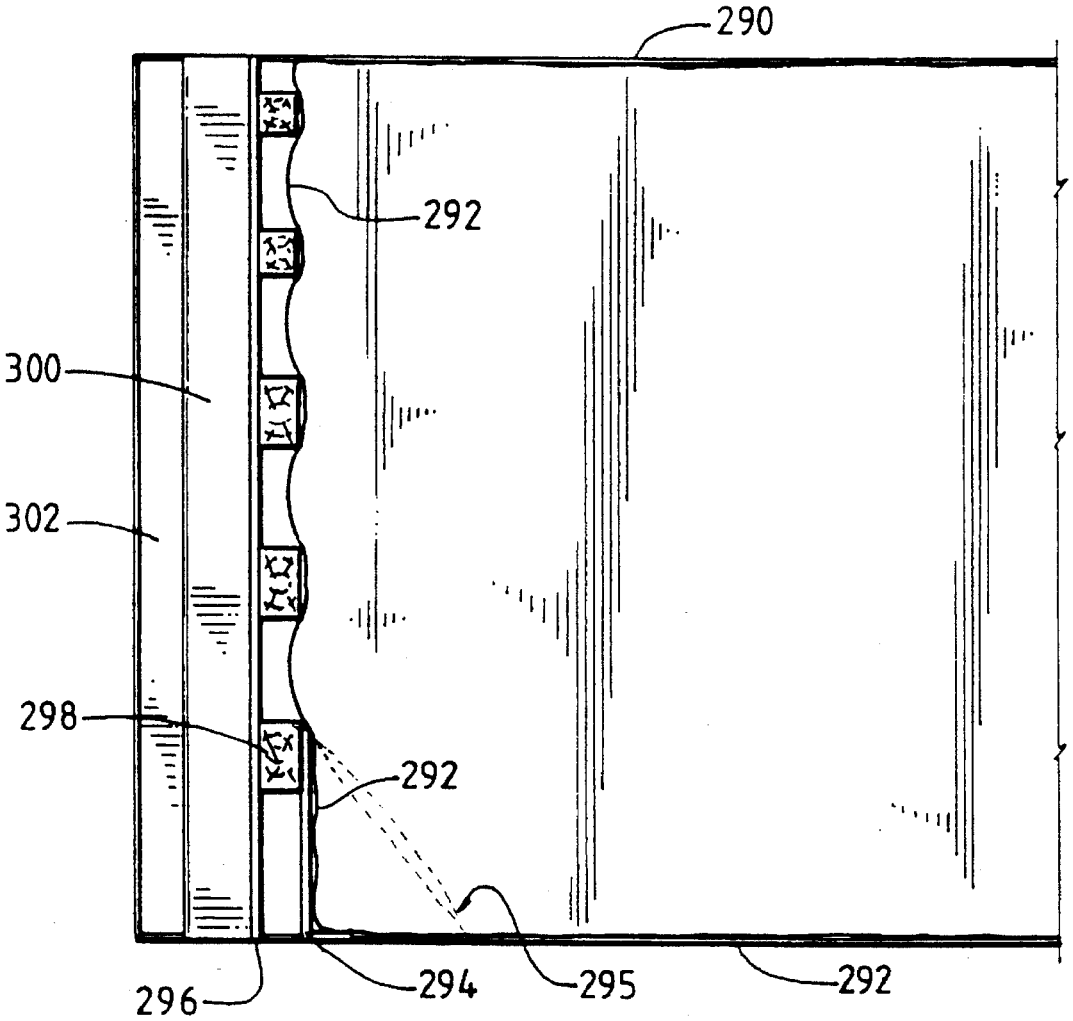
FIG. 9B is a partially cross-sectional view of a transparent bulkhead installed within a container with structural support members, corner bags and liner.

FIG. 9B is a partially sectioned, side view of a transparent bulkhead installed within a container with structural support members, corner bags and liner visible. As one opens rear doors 302, it is apparent that there is spacing 300 between the rear doors 302 and the structural support members 296 (vertical) and other support members such as 298 (horizontal). Through the bracing as well as through the transparent bulkhead 294 liner 292 is visible. The contents and space within the liner 292 as well as within the container 290 are visible through both liner rear panel and bulkhead. Corner bag 295 is visible as well.

A partial top view of the positioning of the bracing, bulkhead and liner is also provided in FIG. 9A. Container 290, typical of commercially used containers, possesses along its interior wall, intervally spaced stiffening members 304, 306 and 308, which serve to stiffen the walls of the container. In many cases, the stiffening member 304 nearest the rear doors may also serve as a door post for attachment of the door hinges. Horizontal structural support members such as 298 are intervally spaced along vertical structural support members such as 296, and are inserted into the channel 310 formed by stiffening members 304 and 306 nearest the rear doors. Bulkhead 294 and liner 292, when cargo is loaded within, transfer the cargo load through horizontal structural support members such as 298 to the container wall via the stiffening member 304.

Figure 10C:
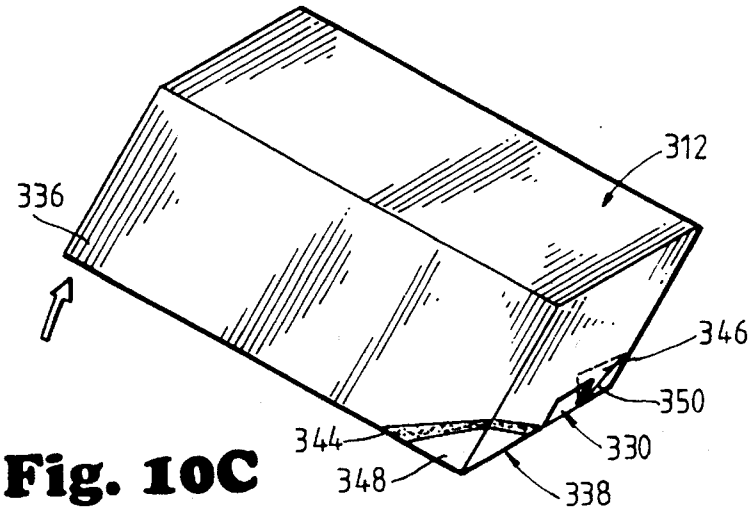
FIGS. 10A–D are stepwise views of the unloading of a phantom container-liner system showing the use of corner bag members.
Figure 10D:
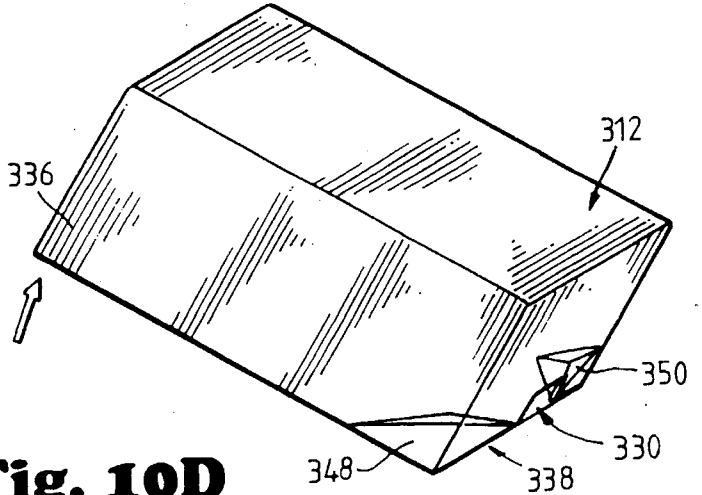
Figure 10A:
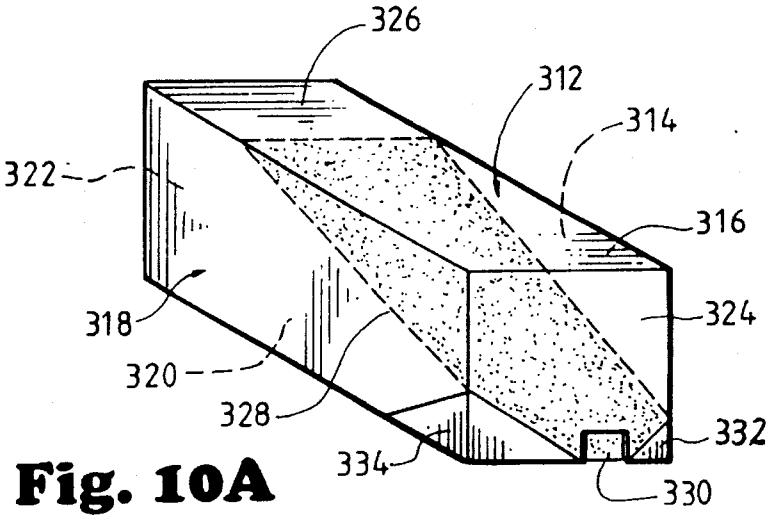

FIGS. 10A–D are stepwise schematic views of the unloading of a filled container-liner system showing the use of corner bag members. The container and/or the liner 312, each includes a top wall 316, side walls 314 and 318, bottom wall 320, front wall 322 and rear wall 324 as shown in FIG. 10A. The liner and container are shown previously loaded in the manner and methods described herein with a flowable cargo 326. While the container and liner are maintained in a level position, cargo 326 has been allowed to establish a natural line of repose 328 by flowing out of port 330. The port 330 is offset toward the right side of the rear wall 324 in order to, for instance, allow access to the unloading port by opening only a single one of the container rear doors. Shown in FIG. 10A, as well, are deflated corner bags 332 and 334.

Figure 10B:
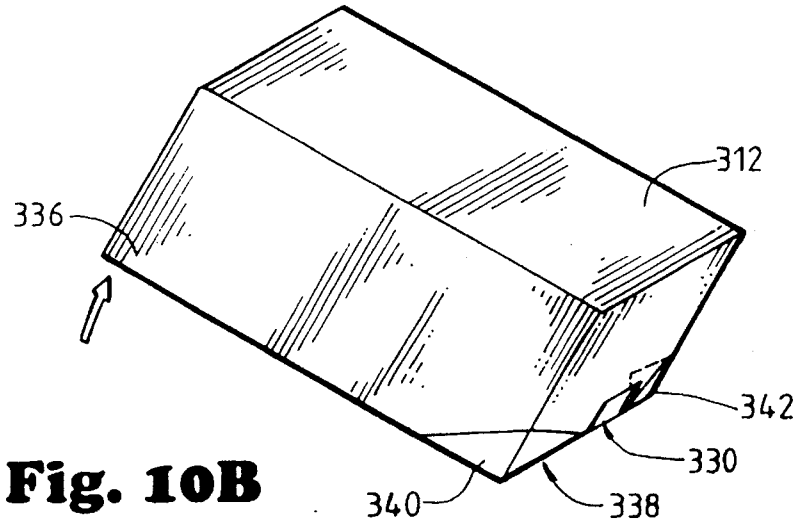

Turning also to FIG. 10B, after the line of repose 328 has been obtained through gravity flow with the container level, the container is typically elevated such that the front wall at position 336 is substantially higher than the rear wall at position 338. This provides for most of the remaining cargo 326 to exit the liner and container through port 330. However, as shown, typically there is a residual amount of cargo, 340 and 342, retained in either lower corner nearest the port 330.

As shown in FIG. 10C, corner bags 348 and 350, partially inflated, have begun to empty residual cargo 344 and 346 through port 330. FIG. 10D shows corner bags 348 and 350 fully inflated and all cargo removed from the container.

The present invention has been described in terms of particular embodiments found or proposed to comprise preferred modes for the practice of the invention. It will be appreciated by those of skill in the art that, in light of the present disclosure, numerous modifications and changes can be made in the particular embodiments exemplified without departing from the intended scope of the invention. All such modifications are intended to be included within the scope of the appended claims.

What is claimed is:

1. Apparatus for lining a cargo container, wherein the container has opposed side walls including an access door in a first such wall, a top and a floor; which apparatus comprises:

(a) an inflatable transparent liner configured when deflated to lie on the floor proximate the wall of the container opposite said first wall and, when fully inflated to display sidewalls, a top and a floor corresponding to the walls, top and floor of the container and fitting within the container in spaced relation with said first wall of the container;

(b) a first inlet connection in the liner positioned, upon inflation of the liner, proximate the top and first wall of the liner for loading a flowable cargo into the liner;

(c) a first outlet connection in the liner positioned, upon inflation of the liner, proximate the floor of the liner and adjacent the access door for unloading a flowable cargo from the liner;

(d) a second inlet connection in the liner positioned, upon inflation of the liner, proximate the end of the liner opposite said first wall;

(e) a compressible conduit for inflating the liner by allowing a flow of gas into the liner, said conduit being attached to the second inlet connection and extending along an external surface of the liner to a position proximate the access door in the rear wall of said container, said conduit becoming increasingly constricted between the container and the liner as the liner is inflated, thereby substantially halting the flow of gas out of the liner through said conduit when said liner is fully inflated;

(f) a transparent bulkhead supported by the container between the liner and said first wall of the container and extending upward from and along the floor of the container; said bulkhead being sufficiently rigid and extensive to resist substantial loading of said access door by cargo within the liner; and (g) inflation bags separately inflatable from the liner positioned, upon inflation of the liner, at intersections between the floor of the container and said bulkhead and between the bulkhead and the liner; said bags configured, upon inflation, to displace cargo within the liner from such intersections.

2. The apparatus of claim 1, wherein the inflatable bags are attached to the liner.

3. The apparatus of claim 1, wherein the second inlet conduit is located in the liner top wall, and the compressible conduit extends along the external surface of the liner top between the top of the liner and the top of the container.

4. The apparatus of claim 1, wherein the bulkhead also extends along the floor of the container toward said opposite wall of the container to define a right angle intersection with the upwardly extending portion of the bulkhead.

5. The apparatus of claim 4, wherein a separate, said inflatable bag is positioned, upon inflation of the liner, proximate each end of said right angle intersection.

6. Apparatus for lining a box-like cargo container having two sidewalls, a front end wall, a rear end wall having an access door, a floor and a top, comprising:

(a) an inflatable transparent liner configured, when deflated, to be placed on the floor of the container, and when fully inflated to display two sidewalls, a front wall, a rear wall, a floor and a top corresponding to the sidewalls, front wall, rear wall, top and floor of the container and fitting within the container in spaced relation with the rear wall of the container;

(b) a first inlet connection in the liner positioned, upon inflation of the liner, proximate the top and rear wall of the liner for the loading of a flowable cargo into the liner;

(c) a first outlet connection in the liner positioned, upon inflation of the liner, proximate the floor of the liner and adjacent the access door for unloading of a flowable cargo from the liner;

(d) a second inlet connection in the liner positioned proximate the front wall of the liner for inflating the liner by allowing a flow of gas into the liner through said second inlet connection;

(e) a compressible conduit attached to the second inlet connection and extending along an external surface of the liner to a position proximate the access door of the container, said conduit becoming increasingly constricted between the container and the liner as the liner is inflated, thereby substantially halting the flow of gas from the liner through the conduit after the liner becomes fully inflated;

(f) a transparent bulkhead adapted to be supported by the container between the liner and the rear wall of the container and extending upward from and across the floor of the container; said bulkhead being sufficiently rigid and extensive to resist substantial loading of said access door by cargo within the liner; and (g) inflatable bags separately inflatable from the liner positioned, upon full inflation of the liner, external of the liner at intersections between the bulkhead and the floor of the container; said bags configured upon inflation to displace cargo within the liner from such intersections.

7. The apparatus of claim 6, wherein the bottom of the front end wall of the liner is adapted to be attached across the bottom of the front end wall of the container, and the top of the front end wall of the liner is adapted to be attached across the top of the front end wall of the container.

8. The apparatus of claim 7, wherein the top of the rear end wall of the liner is adapted to be attached across the top of the rear end wall of the container.

9. The apparatus of claim 6, wherein the second inlet connection is positioned on the liner top wall, and the collapsible conduit extends along the external surface of the top of the liner.

10. A liner for holding a flowable cargo in a box-like container having a floor, a top, two sidewalls, a front end wall, and a back end wall with an access door, which liner comprises:

(a) a transparent inflatable member foldable when deflated into a compact package and inflatable from such package to form a box-like liner having a floor, a top, front and back end walls and two sidewalls lining said container with the back end walls of the container and the liner facing each other in spaced relation;

(b) a first inlet proximate the back and top of the liner when inflated for loading cargo into the liner;

(c) an outlet proximate the back and floor of the liner when inflated for unloading cargo from the liner through the access door; and (d) a second inlet proximate the front of the liner for supplying gas to inflate the liner, wherein the second inlet comprises a compressible conduit configured to extend along the outer surface of the liner to the back of the liner proximate the access door, said conduit becoming increasingly constricted between the liner and the container, as the liner is inflated, to substantially prevent deflation of the inflated liner caused by the flow of gas from the liner through said conduit.

11. A liner for a bulk cargo container, which liner is self-installing by forced gas inflation and capable of containing bulk cargo and separating the cargo from the interior surfaces of the container, said liner comprising: an inlet connection for introducing a gas therein, said inlet connection being disposed on said liner at the distal end thereof with respect to an access door in the container; and a compressible tube attached to the inlet connection, said tube extending along the external surface of the liner to a position proximate the access door, wherein said tube becomes increasingly constricted between the liner and the container as the liner self-installs, thereby substantially halting the flow of gas out of the liner through said tube when the liner is fully installed.

12. A liner for a box-like cargo container having top and bottom walls, four sidewalls and an access door at a first end, which comprises:

(a) an inflatable, transparent member insertable within the container and configured upon inflation to line the container with a first end corresponding to the first end of the container, and a second end opposite the first end;

(b) an inlet port proximate the top of the first end of the inflatable member, when inflated;

(c) an outlet port proximate the bottom of the first end of the inflatable member, when inflated; and (d) a compressible conduit member connected to the second end of the inflatable member for inflating the liner by introducing gas into the inflatable member, said conduit member extending along the top of the inflatable member from the second end of the inflatable member to the first end, and becoming increasingly constricted between the inflatable member and the container as the inflatable member inflates, thereby substantially halting gas flow from the inside of the liner, when fully inflated, back through said conduit member.

13. The liner of claim 12, which further comprises:

a first connector at said opposite end of the inflatable member adapted to support said opposite end of the inflatable member from the corresponding opposite end of the container.

14. The liner of claim 13, which further comprises:

a second connector at said first end of the inflatable member adapted to support the inflatable member from said first end of the container.

15. The liner of claim 14, wherein the first and second connectors and the conduit member are configured to be capable of attachment to conduits outside the container when the access door is open.

16. The liner of claim 15, which further comprises a rigid, transparent bulkhead adapted to be interposed between the first end of the inflatable member and the first end of the container.

* * * * *